US007917970B2

(12) United States Patent
Shimshony

(10) Patent No.: US 7,917,970 B2
(45) Date of Patent: Apr. 5, 2011

(54) HOODED GARMENT HAVING AN INTEGRATED CAP AND VISOR

(76) Inventor: Itamar Shimshony, Tel-Aviv (IL)

( * ) Notice: Subject to any disclaimer, the term of this patent is extended or adjusted under 35 U.S.C. 154(b) by 312 days.

(21) Appl. No.: 12/000,769

(22) Filed: Dec. 17, 2007

(65) Prior Publication Data

US 2009/0151044 A1 Jun. 18, 2009

(51) Int. Cl.
*A41D 3/02* (2006.01)
*A42B 1/04* (2006.01)

(52) U.S. Cl. ..... 2/84; 2/108; 2/202

(58) Field of Classification Search ..... 2/84, 202, 2/209.12, 209.13, 88, 175.1, 195.1, 203–205, 2/93, 108, 85, 90, 91, 115, 207, 171, 208, 2/171.1, 171.4, 171.5, 171.6, 172, 181, 184.5, 2/209.3–209.7, 209.11, 4, 422, 410; D2/825, D2/831, 882, 879
See application file for complete search history.

(56) References Cited

U.S. PATENT DOCUMENTS 1,117,456 A * 11/1914 Skliba ..... 2/98
1,626,288 A * 4/1927 Lane ..... 2/84
2,086,325 A * 7/1937 Frankel ..... 2/84
D120,721 S * 5/1940 Posin ..... D2/878
2,374,643 A * 5/1945 Boettcher ..... 2/114
2,547,931 A * 4/1951 De Grazia ..... 2/84
2,655,256 A * 10/1953 Guest ..... 206/8
3,100,896 A * 8/1963 Khanbegian ..... 2/5
4,272,853 A * 6/1981 Schuessler ..... 2/424
4,329,742 A * 5/1982 Schuessler ..... 2/424
4,823,407 A * 4/1989 Phillips et al. ..... 2/202
5,056,160 A * 10/1991 Buchanan ..... 2/88
5,644,799 A * 7/1997 Armenta et al. ..... 2/209.13
D404,846 S * 1/1999 Day ..... D29/106
5,881,389 A * 3/1999 Fruge ..... 2/202
7,380,286 B1 * 6/2008 Bryant, Sr. ..... 2/84
2005/0241045 A1 * 11/2005 Tolton ..... 2/84
2006/0288465 A1 * 12/2006 Delorenzo et al. ..... 2/84
2007/0174944 A1 * 8/2007 Grilliot et al. ..... 2/84
2009/0055991 A1 * 3/2009 Johnson et al. ..... 2/84
2009/0083898 A1 * 4/2009 Shirey ..... 2/209.7
2009/0178176 A1 * 7/2009 Rowe et al. ..... 2/172
2009/0255030 A1 * 10/2009 Guy ..... 2/84

* cited by examiner

*Primary Examiner* — Amy B Vanatta

(74) *Attorney, Agent, or Firm* — Graeser Associates International Inc

(57) ABSTRACT

A fashionable hooded garment having an integrated cap and visor.

12 Claims, 3 Drawing Sheets

FIG. 2A
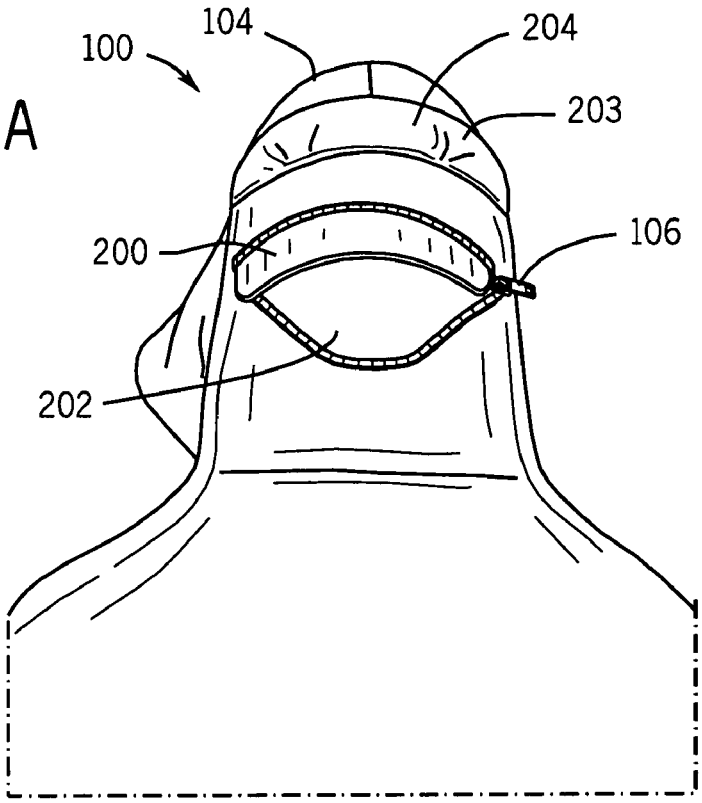
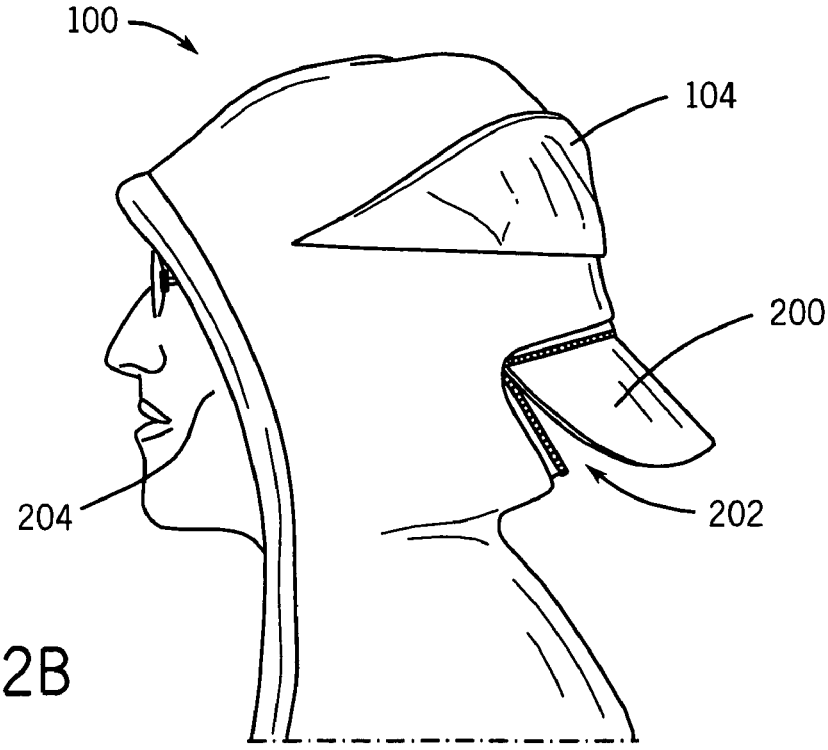
FIG. 2B

HOODED GARMENT HAVING AN INTEGRATED CAP AND VISOR

FIELD OF THE INVENTION

The present invention relates to fashionable hooded garments like a jacket, sweater, pullover, or jumper having a cap and visor or baseball cap removably integrated with the garment.

BACKGROUND OF THE INVENTION

Hooded garments such as jackets and sweatshirts are a popular and fashionable clothing item. A hooded garment allows a person to fully cover the back and both sides of the head while partially shielding the face. The hooded garment can protect the head from the elements particularly in bad weather such as wind, snow or rain.

Hats comprising the basic components of a cap and visor like a baseball hat are a very popular and fashionable clothing item. The way in which a cap is worn may also constitute a fashion statement or a fashion choice by its wearer. For example, traditionally a hat is worn with the visor portion facing forward extending from the forehead so as to shield the eyes. However, it has recently become popular or fashionable to wear a hat backwards, with the visor portion extending from the back of the head shielding the back side of the neck or nape. Similarly it has become fashionable to wear a hat sideways wherein the visor extends over the left or right ear.

The combination of hooded garment and hats has become fashionable; however, the current hooded garments are limiting in that they only allow a hat to comfortably be worn in the traditional manner, where the visor portion extends from the forehead. Currently hooded garments do not accommodate the wearing of a hat in the backward or sideways position.

Similarly, the prior art does not teach or suggest the ability to wear both a hat and a hooded garment where the visor does not extend from the forehead to cover the face of a user.

US Patent Publication 2006/0288465 to Delorenzo et al describes a hooded garment with a built in skull cap and gloves to functionally protect a wearer from the elements such as bad weather. Delorenzo does not teach a hooded garment capable of allowing a person to wear a cap and visor in the backward or sideway positions.

US Patent Publication 2005/0241045 to Tolton describes a hooded garment that allows a wearer to wear a hat with a visor however only in the traditional or forward position. Tolton does not teach or suggest a hooded garment that allows a wearer to place the visor portion in the backward or sideway positions.

U.S. Pat. No. 6,023,787 to French et al teaches a hood with a forward facing visor that protects a wearer from the elements, particularly cold or bad weather. French does not teach or suggest a hooded garment that allows a wearer to place the visor portion in the backward or sideway positions.

SUMMARY OF THE INVENTION

There is an unmet need for, and it would be highly useful to have, a fashionable hooded garment that allows one to integrate a hat worn in any given position, including but not limited to forward, backward or sideways.

The present invention overcomes the deficiencies of the background by providing a hooded garment that allows a person to simultaneously wear both a hooded garment and a hat having the visor extend from the back of the front, back or side of the head, such that optionally any such position may be provided for the hat.

A hooded garment comprises a garment that continuously covers both the upper torso and the head on all sides but the face. The portion covering the head is known as and is commonly referred to as a hood.

The hooded garment of the present invention provides a hooded garment that optionally further comprises a hat and an opening along the perimeter of the hood portion. The hood portion of the hooded garment of the present invention enables a person to wear a hat in a number of styles while wearing the hood portion of the hooded garment. The hood portion comprises at least one or more openings along the perimeter of the hood portion that allows a hat visor to be threaded therethrough.

An optional embodiment of the present invention is a hooded garment comprising an opening along the perimeter of the hood portion. Optionally, the opening may be located continuously along the perimeter of the hood portion. Optionally and preferably an opening may be located at various locations along the perimeter of the hood portion, preferably including but not limited to the back, left side or right side. Optionally, at least one or more opening may be intermittently located along the perimeter of the hood portion; preferably at least one opening is located at the back, left or right side of the hood portion of the garment.

Preferably at least one or more openings along the perimeter of the hood portion of the hooded garment may be controllably opened or closed. Optionally opening or closing may be accomplished by various means for garment fastening for example including but not limited to a zipper, overlapping garment flaps or segments, hook and loop assembly, Velcro, button, or the like.

Preferably the hooded garment having at least one or more opening along the perimeter of the hood in the open position allows a user to thread through the opening a visor portion of a hat, thereby allowing the user to wear both a hooded garment and a hat, with the hood also worn on the head of the user. Optionally a cap portion is kept in place on the head of the user while the visor may optionally be placed to extend from the back side, left side or right side of the hood portion of the garment.

A further optional embodiment of the present invention is a hooded garment with an integrated cap and visor coupled by a coupling mechanism including but not limited to stitching, Velcro, button, zipper, hook or other fastener or the like. Preferably the cap portion is attached to the inner side of the hood portion of the garment while the visor portion extends from an opening located at any one of the back side, left side or right side of the hood portion.

A further optional embodiment of the present invention is a hooded garment with an integrated visor coupled through a coupling mechanism as previously described. Preferably the visor portion is attached to the exterior of the hood portion and extends from any one of the back side, left side or right side of the hood portion.

The hooded garment or hat of the present invention may optionally comprise any fabric, cloth, material or combination thereof as is known and accepted in the art. Therefore the manufacture of the garment is not limited to any type, composition or combination of fabric or material as is known and accepted in the art.

BRIEF DESCRIPTION OF THE DRAWINGS

The invention is herein described, by way of example only, with reference to the accompanying drawings. With specific reference now to the drawings in detail, it is stressed that the particulars shown are by way of example and for purposes of illustrative discussion of the preferred embodiments of the present invention only, and are presented in order to provide what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

In the drawings:

FIG. 2A-D are different views of the hooded garment according to the preferred embodiment of the present invention.

DESCRIPTION OF THE PREFERRED EMBODIMENTS

The present invention is of a hooded garment that allows a person to wear a hat in any chosen direction while the hood is also worn on the head of the user. The principles and operation of the present invention may be better understood with reference to the drawings and the accompanying description.

Figure 1A:
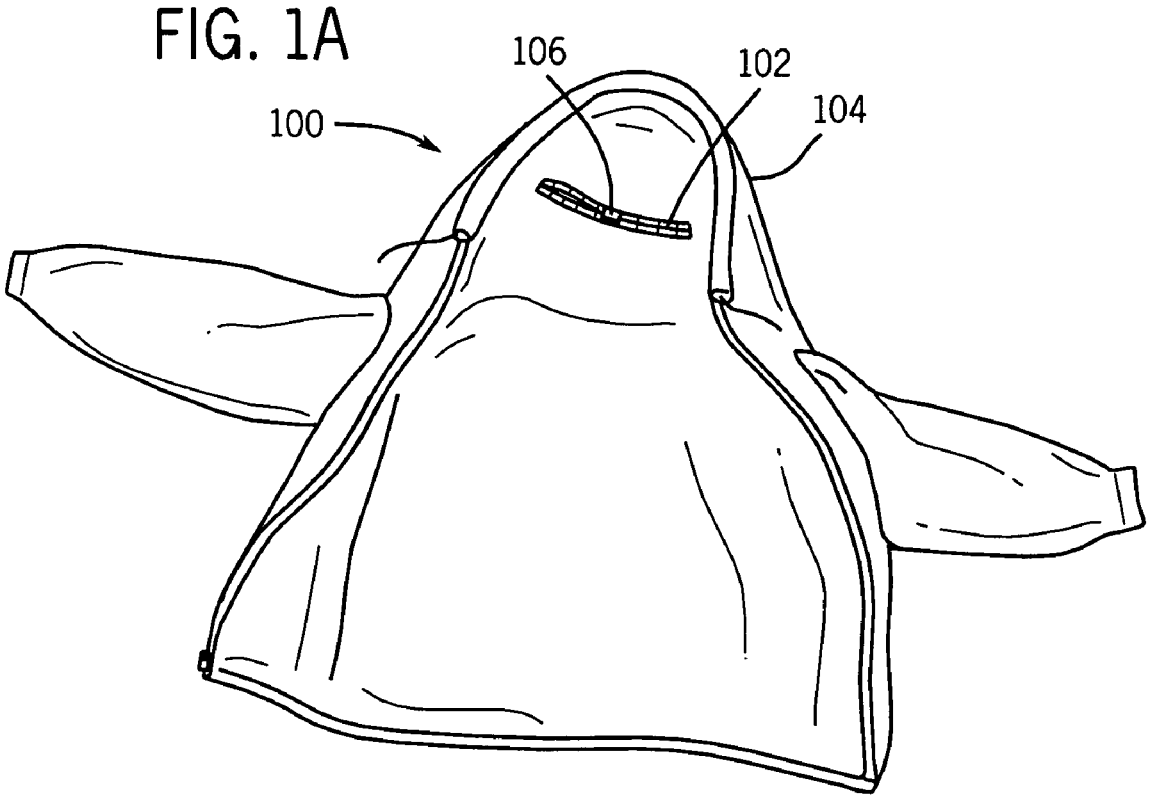
FIG. 1A-B are diagrams of an exemplary hooded garment according to a preferred embodiment of the present invention.
Figure 1B:
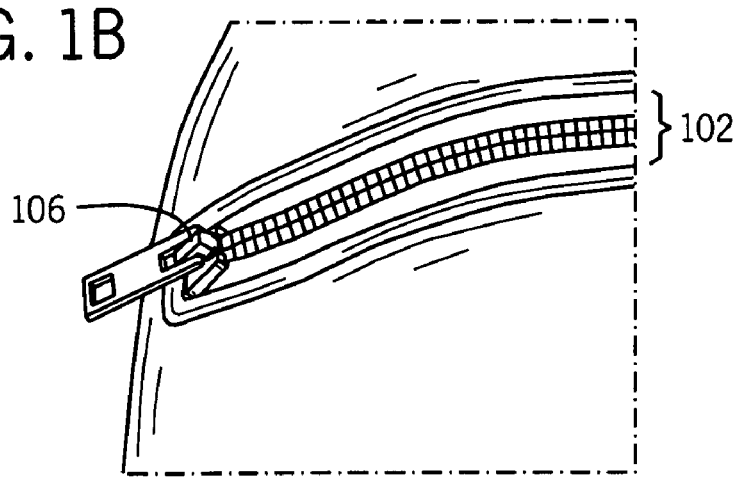

Referring now to the drawings, FIG. 1A is a photograph of the hooded garment 100 according to a preferred embodiment of the present invention. Garment 100 comprises a hood portion 104 and an opening 102 that is controllably opened or closed by various mechanisms including but not limited to a zipper 106 as shown. Opening 102 may similarly be controllably opened or closed by any fastener including but not limited to a button, hook and loop, Velcro or the like. FIG. 1B depicts a close view of opening 102 and zipper 106, showing more details therein.

FIG. 2 shows various views of the hooded garment coupled with a hat according to the present invention. FIG. 2A shows a posterior view of the hooded garment 100 of FIG. 1 already integrated with a hat 203 worn in a backward fashion, while hood 104 is also worn on the head 204 of the user The posterior view shows garment 100 and visor portion 200 that extends from the back side of hood 104 through opening 202; opening 202 remains in an open position with zipper 106. Opening 202 allows a user to thread visor 200 through hood 104, thereby protruding and extending visor 200 from the back of hooded garment 100. Similarly, visor 200 may optionally extend from the side of garment 100 when the opening is positioned over either of the left or right side of hood 104.

FIG. 2B depicts a side view of the hooded garment 100 integrated with a hat 203 worn backwards through opening 202. The cap portion (not shown) of hat 203 is worn on head 204 underneath hood portion 104.

Figure 2C:
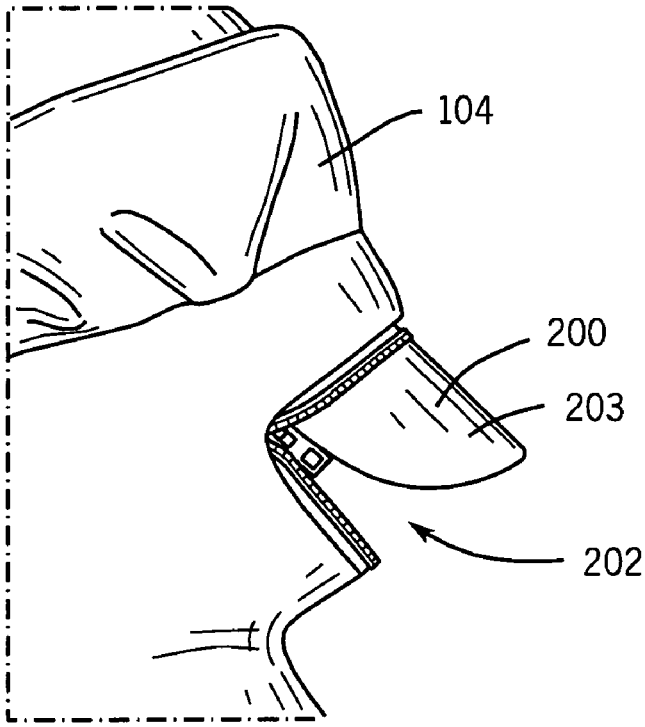
Figure 2D:
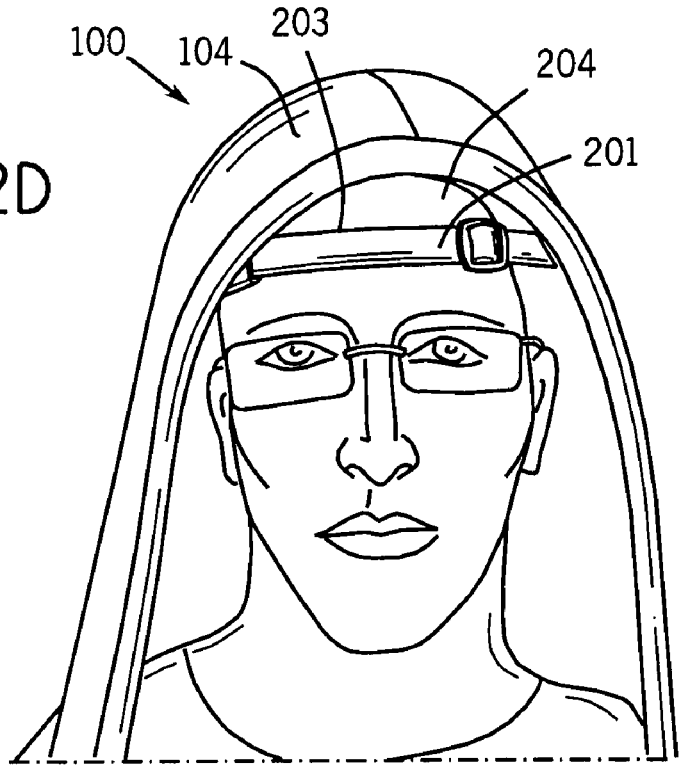

FIG. 2C is a close up view of visor 200 extending from the backside of hood 104 through opening 202. FIG. 2D is a front view of hooded garment 100 integrated with the front of head 204 having hat strap 201.

The embodiment shown in FIG. 2 may optionally be described as a hood system, comprising hood 104, hat 203 and opening 202 in hood 104. The embodiment shown in FIG. 2 may also optionally be described as a hooded garment system, comprising hooded garment 100 which comprises hood 104 and opening 202 in hood 104; and hat 203. For both systems, visor portion 200 is inserted through opening 202 to protrude from hood 104.

While the invention has been described with respect to a limited number of embodiments, it will be appreciated that many variations, modifications and other applications of the invention may be made.

What is claimed is:

1. A hooded garment including a garment that continuously covers both the upper torso and the head on all sides but the face of a user, wherein the garment covering the head defines a hood portion of said hooded garment, wherein said hood portion comprises at least one opening along the perimeter of said hood portion located at a position selected from the group consisting of the back, left or right side of said hood portion, and wherein said hood portion comprises an integrated visor that may extend from said at least one opening.

2. The hooded garment of claim 1 comprising more than one of said at least one opening, wherein said openings are intermittently placed along the perimeter of said hood portion.

3. The hooded garment of claim 1 wherein said at least one opening may be opened or closed.

4. The hooded garment of claim 1 further comprising a zipper along opposing edges of said opening, to open or close said opening.

5. The hooded garment of claim 3 further comprising overlapping garment segments along the length of said opening.

6. The hooded garment of claim 1 further comprising a hook and loop at opposing edges of said opening to open or close said opening.

7. The hooded garment of claim 1 further comprising a button and buttonhole at opposing edges of said opening.

8. The hooded garment of claim 1 further comprising a fastener for fastening opposing edges of said opening.

9. A hooded garment comprising a garment that continuously covers both the upper torso and the head on all sides but the face of a user, wherein the garment covering the head defines a hood portion of said hooded garment; and wherein said hood portion comprises an integrated cap, said integrated cap comprising a visor, and wherein said hood portion comprises at least one opening located at a position selected from the group consisting of the back, left or right side, and wherein said visor protrudes from said hood portion through said at least one opening.

10. The hooded garment of claim 9 wherein said cap and visor are integrated with said hood portion using a closing mechanism selected from the group consisting of stitch, hook and loop, button and zipper.

11. The hooded garment of claim 9 wherein said visor extends from the back side of said hood portion.

12. The hooded garment of claim 9 wherein the visor extends from the left or right side of said hood portion.

* * * * *